United States Patent [19]

Baxter et al.

[11] Patent Number: 4,900,471

[45] Date of Patent: Feb. 13, 1990

[54] SURFACE TREATMENT OF PEROXYACIDS

[75] Inventors: Paul L. Baxter, Warrington; Michael J. L. Whiting, Liverpool, both of England

[73] Assignee: Interox Chemicals Limited, London, England

[21] Appl. No.: 38,365

[22] Filed: Mar. 23, 1987

[30] Foreign Application Priority Data

Mar. 22, 1986 [GB] United Kingdom ..... 8607164

[51] Int. Cl.[4] ..... C11D 3/39; C11D 3/30

[52] U.S. Cl. ..... 252/186.26; 252/91; 252/102; 252/148; 252/174.13; 252/186.32

[58] Field of Search ..... 252/186.32, 148, 186.26, 252/174.13, 91, 102

[56] References Cited

U.S. PATENT DOCUMENTS

| | | | |
|---|---|---|---|
| 3,847,830 | 11/1974 | Williams et al. . | |
| 3,868,336 | 2/1975 | Mazzola et al. | 252/174.13 X |
| 3,962,149 | 6/1976 | Chirash et al. | 252/174.13 X |
| 3,983,254 | 9/1976 | Alterman et al. . | |
| 4,126,573 | 11/1978 | Johnston | 252/186.26 X |
| 4,327,151 | 4/1982 | Mazzola | 252/99 X |
| 4,374,747 | 2/1983 | Tai | 252/186.26 |
| 4,655,780 | 4/1987 | Chun et al. | 252/174.13 X |
| 4,664,836 | 5/1987 | Taylor, Jr. et al. . | |
| 4,726,908 | 2/1988 | Kruse et al. | 252/174.13 X |
| 4,728,453 | 3/1988 | Choy | 252/102 |
| 4,820,436 | 4/1989 | Andree et al. | 252/90 X |

FOREIGN PATENT DOCUMENTS 027693 4/1981 European Pat. Off. .

*Primary Examiner*—Howard J. Locker
*Assistant Examiner*—Gary Geist
*Attorney, Agent, or Firm*—Larson and Taylor

[57] ABSTRACT

Under conditions of misuse, water-soluble peroxyacids when they are left in direct contact with dyed fabrics can cause spotting and dye damage. The problem can be ameliorated by surface-treating the peroxyacid with an effective amount, preferably selected in the range of 8 to 25% w/w based on the peroxyacid, of aliphatic amines which melt or soften at about 30° to 70° C. Preferred agents include hydrogenated tallow amine dicocoamine and methyl dihydrogenated tallow amine. The agent can be applied in molten fashion or in inert solvent such as a chlorinated aliphatic hydrocarbon onto agitated particles of the peroxyacid.

9 Claims, No Drawings

SURFACE TREATMENT OF PEROXYACIDS

The present invention relates to water-soluble peroxyacids and in particular to treatments to particles or granules of such peroxyacids, compositions for and processes of washing and cleansing employing such treated peroxyacids.

Herein, by the term "water-soluble peroxyacids" we mean either inorganic or organic peroxyacids which can dissolve in water at 25° C. to a concentration of at least 10 grams per liter. Under normally recommended conditions for washing or cleansing dyed garments or other domestic fabrics in the home, the washing compositions are premixed with a considerable volume of water thereby avoiding prolonged static contact with the washload. However, it has been found that under non-recommended conditions of use, and particularly when a solid powder is left in direct contact with a damp wash load there is a potential for the dye, in the locality of water-soluble peroxyacids to be oxidized, resulting in spotting of the wash load and fading of the dye.

The undesirability of dye damage has been appreciated in the art already. Thus, for example in U.S. Pat. No. 4,126,573, column 1, Johnston equates decreasing solubility with . . . possible fabric and dye damage which are undesirable, and subsequently teaches that by coating the peroxyacid products with a surfactant compound he can formulate products which maintain . . . fabric safety through improved solubility over an extended shelf period. He asserts that the invention is applicable to both aliphatic and aromatic peroxyacids and his description includes both the relatively insoluble peroxyacids such as diperoxydodecanedioic acid and more soluble peroxyacids such as monoperoxyphthalic acid. Whilst the assertions concerning prevention of dye damage may be well founded insofar as insoluble peroxyacids are concerned, although no data is presented in the specification specifically to that end, the presence of surfactant in the vicinity of water-soluble peroxyacids does not ameliorate i0 the problem of dye damage under the conditions of mis-use described hereinbefore.

It has hitherto been suggested to coat peroxygen compounds with a physical barrier of inorganic or organic materials with a view to isolating the peroxygen compound from its environment during storage. Thus, for example, in U.S. Pat. No. 3,494,787 (Lund and Nielsen) there has been described the coating of diperoxyphthalic acids with a desensitizing diluent material, and in particular magnesium sulphate. Such a material has the attribute of being compatible with the peroxygen compound that is being coated, and accordingly does not induce the compound to decompose with consequential loss of available oxygen (avox) However, its use does not offer any solution to the misuse dye damage problem. Indeed, for the many of the water-soluble peroxyacids that are sufficiently stable and resistant to decomposition or impact or thermal shock, use of such a coating represents an unnecessary process step, the only significant effect of which is to increase the price of the product on an avox basis.

European Pat. No. 0027693 (Interox Chemicals Limited- Hignett) describes magnesium salts of percarboxylic acid/carboxylate compounds (MPX) in intimate contact by coating or intimate admixture with a range of inorganic or organic substances, including the aforementioned sulfates but not specifically in the context of ameliorating dye damage. In the course of the investigations leading to the present invention, many substances have been coated onto the soluble peroxyacid particles and their effect on dye damage measured. Regrettably, very few showed significant amelioration of the problem. It has now been found, surprisingly, that a restricted class of amines can be used successfully. It has also been suggested in U.S. Pat. No. 4,045,358 that the tendency of fabric softening compositions to cause yellowing of fabrics can be reduced by incorporating therein a minor amount of a perphthalic acid, the weight ratio of cationic softener to perphthalic acid being 4:1 to 1:1. Solid products are obtained by dry blending the ingredients, and they can also be agglomerated, pelletized or shaped. The disclosure, accordingly, does not address directly the dye damage problem which the instant inventors where seeking to solve, nor does it suggest or imply a solution. Not only would such large amounts of softener if present in the form of a coating retard dissolution of the coated peroxygen compound to an unacceptable slow rate under low temperature wash conditions, but there would also be a much increased likelihood of the coated material forming a sticky non-flowing mass, especially with those softeners that melt in the region of low wash temperatures. It will be recognised that for the instant invention, an effective amount of the selected surface treatment agents implies not only an amount at or above a minimum but also an amount at or below a maximum.

According to the present invention there is provided a process for treating a peroxyacid so as to ameliorate dye damage caused by contact between a particulate water-soluble peroxyacid and a damp fabric in which the particulate peroxyacid is surface-treated with an effective amount of an aliphatic or cycloaliphatic amine which melts or softens at a temperature of from about 30° C. to 70° C.

By effecting such a surface treatment with such an amine the dye damage caused by misuse can be ameliorated without the storage stability of the soluble peroxyacid being impaired.

Soluble peroxyacids for treatment according to the present invention process include potassium monopersulfate (KMPS), potassium-4-sulfoperoxybenzoic acid (KSPB), monoperphthalic acid and, especially, magnesium monoperoxyphthalate. The peroxyacid compounds may be in the form of individual powder grains or have already been aggregated or agglomerated into granules or extrudates. The instant invention isparticularly suited to the treatment of granular magnesium monoperoxyphthalate, which is obtained by granulating feed particles of mainly below 0.2 mm diameter, and KMPS and KSPB all of which in practice have an average particle diameter of from 0.10 to 1.0 mm.

The surface treatment agent can be a primary, secondary or tertiary amine which meets the melting point criterion. In practice, the aliphatic residue in the primary amine and at least one of the aliphatic residues in the secondary or tertiary amines normally contains at least 10 and typically 12 to 20 linear carbon atoms, on average. Such a long chain aliphatic residue is very preferably a saturated hydrocarbon residue, such as stearate. The advantage of saturated residues accrues because they do not react with peroxyacid compounds in the way that unsaturated hydrocarbons can. The stearate group can be replaced by laurate, palmitate or myristate if desired, or by a mixture derived from natural sources such as hydrogenated tallow which is mainly $C_{16}$ and $C_{18}$ or cocoa which is mainly $C_{12}$ and $C_{14}$. These agents have a waxy feel, melting or softening in the desired temperature range of 30° to 70° C. and in many cases 35° to 60° C. For secondary or tertiary amines two of the residues are preferably long chain, i.e. having at least 8 linear carbon atoms, and likewise both are most advantageously saturated. Any remaining aliphatic residue is preferably a short chain alkyl such as methyl, ethyl or propyl. It is observed that by selecting such compounds it is possible to obtain the desired benefit of ame.liorating the stated problem whilst avoiding to at least a considerable extent both the potential problems of caking caused by partial melting and resolidification of the treatment agent during storage and/or transportation and of failure to release the peroxyacid compound into solution at the wash temperatures contemplated for peroxyacids. It will be recognised that it is a very narrow selection of treatment materials which properly meets the practical criteria outlined hereinbefore. For the avoidance of doubt, the class of usable amines excludes alkanolamines.

If desired, the surface treatment agent can include additionally a mono, di or tri ester derivative of the polyol, the fatty acid residue normally containing at least 12 and typically 14 to 20 linear carbon atoms. The polyol moiety can be linear such as glycerol or sorbitol or a condensed ring such as sorbitan or can be branched such as pentaerithrytol. Representative examples of the surface treating agent include glycerol monostearate, sorbitan mono or tri stearate and penta-erythritol distearate. The stearate group can be replaced by laurate, palmitate or myristate if desired. These treatment agents have a waxy feel, melting or softening in the desired temperature range of 35° to 70° C. and preferably 40° to 60° C. Any weight ratio of the amine and ester components of the surface treatment agent can be used, such as from 2:1 to 1:2.

The amount of surface treatment agent to employ is normally at least 5%, percentages herein being by weight of the peroxyacid compound before coating unless otherwise stated, and often is less than 30%. The amount in many instances is selected in the range of 8 to 25%. It is believed the treatment deposits the agent as coating upon the surface of the peroxyacid compound which may act as a barrier or retardant to the ingress of water and/or egress of a saturated solution of peroxyacid. However, the invention itself is not dependent upon any theory or belief, but instead is based upon a practical demonstration of the effectiveness of the selected agents.

The surface treatment of the particulate peroxyacid can be effected by bringing the agent in liquified form into contact with the peroxyacid particles whilst agitating the particles so as to randomly distribute the liquified agent over the surface of the particles. There are two main methods for liquifying the agent. The first comprises heating the agent until it melts or softens, so that it can be sprayed, thereby forming small liquid globules which on impact with solid peroxygen particles spread over the surface of the latter. There are two variations of the melt method possible, in the first of which the agent is first melted externally and then sprayed onto the agitated particles. In the second variation the agent is melted in situ by, for example, the method of U.S. Pat. No. 4,421,669 (Brichard- Interox) the updraft of inert gas employed to fluidize and randomly agitate the particles.

Preferably the molten agent is sprayed at a temperature of 60° to 80° C. and conveniently at a gauge pressure of 4 to $8\times10^4$ Pa.

In the second method of liquifying the agent, it is dissolved in a low boiling point organic solvent which is sprayed onto or can be slurried with the particles, depositing the agent on the surface on evaporation of the solvent. This latter method is especially well suited to small scale operations and the molten method to a larger scale. The organic solvent preferably boils at below 70° C., and preferably from 35° to 70° C. under the pressure conditions employed. The most preferred organic solvents are the low boiling point chlorinated hydrocarbons such as dichloromethane, dichloroethane, and trichloroethane, in that they are not only capable of dissolving the selected agents but also do not in themselves significantly cause decomposition of the peroxyacid. Other solvents that may be employed, if desired, include low molecular weight aliphatic esters such as ethyl acetate or propionate. It is usually more convenient to spray a saturated or near saturated solution of the agent since thereby the amount of solvent to recover is minimised. The solutions can conveniently be sprayed at 8 to $15\times10^4$ Pa gauge pressure.

Various types of apparatus can be used for agitating the particles during the surface treatment operation. These in general fall into the categories of mechanical agitation or gas flow agitation. The former category comprises rotating pans normally inclined at a small angle to the horizontal and rotating about a near vertical axis. The tumbling motion progressively and randomly exposes the solids to a spray of liquified treatment agent. In a further variation the particles can be agitated by a vibrator which again has the effect of randomly liftig them into the air. The latter category includes especially usefully fluidized beds in which the particles are supported by an updraft of a fluidizing gas, the flow of gas within the confines of the bed causing randomized motion of the particles. The fluidized bed is a particularly flexible apparatus to employ in that it can readily ensure efficient contact between liquified treatment agent and simultaneously obtain removal by vaporization of solvent and temperature regulation of the treatment agent during the treatment process. It is particularly appropriate to carry out the treatment batchwise or continuously.

Irrespective of the apparatus employed and in order to avoid excessive decomposition of the peroxyacid during the surface treatment, it is advantageous to keep the temperature of the particles at less than 70° C. and most preferably below 65° C. during the surface treatment, particularly for magnesium monoperoxyphthalate and KMPS. When the agent is employed in molten form a peroxyacid particle temperature of similar to or slightly lower than the melting point of the surface treatment agent is preferred and when a non-aqueous solution is employed, a particle temperature of up to 50° C. is preferable, a temperature of about ambient, such as 20° to 30° C., being very convenient.

In a variation that is particularly convenient on a small scale, a rotary evaporator is used to evaporate low boiling point solvent from a slurry of peroxyacid particles and solution of surface treatment agent, generally under reduced pressure conditions, preferably below 1500 Pa. In order to promote even distribution of treatment agent, it is preferable to employ a similar volume of solution to weight of solid phase, so that variation in the concentration of agent in solution represents the most convenient way of adjusting the amount of agent employed to treat a unit amount of peroxyacid.

The surface treated peroxyacids can be employed in any washing or detergent or bleaching compositions that heretofore have incorporated the corresponding untreated peroxyacids, especially particulate compositions. If desired the amount of peroxyacid included in such compositions can be upwardly adjusted proportionately to compensate for the extra weight of the surface treatment agent. Thus, by way of example the treated peroxyacids may be employed correspondingly in the compositions of U.S. Pat. No. 4,403,994 (Hignett) in the case of magnesium salts of peroxyacid/carboxylate compounds or European Patent Specification No. 124968 (Interox Chemicals Limited) in the case of potassium p-sulfoperoxybenzoic acid and KMPS can be substituted for either of magnesium or potassium salts in such compositions. The two specifications are incorporated herein by way of reference. Likewise the compositions can be employed under the washing or bleaching process conditions described in such specifications, with the added reassurance that the extent of dye damage that may occur should the powders accidentally remain in contact for extended periods with a damp wash load will be markedly and detectably less as a result of the peroxyacids being surface treated in accordance with the present invention.

By way of a summary, washing compositions typically will contain the surface treated peroxyacid one or more surfactants (and usually a mixture of nonionic and anionic surfactants) one or more detergent builders, often including sodium tripolyphosphate, which can sequester water hardness cations, adjust the wash liquor to an appropriately alkaline pH, e.g. pH 7.5 to 10.5 and often pH 8.5–10. Amongst other functions, a diluent such as sodium sulfate, and various detergent adjuncts - minor components including suds control agents, metal sequestrants such as the aminophosphonic acid salts, soil antiredeposition agents and oxidant-resistant optical brightening agents. The customary amounts of the various components can be used. The washing processes are typically from ambient (20°–25° C.) up to 95° C., and in many instances are hand hot - i.e. about 40° to about 50° C., at washing composition concentrations of 1 to 25 g/l.

Having described the invention in general terms specific examples will now be given in more detail.

In all the Examples, the peroxyacid employed was granulated magnesium monoperoxyphthalate (INTEROX H48) (Trademark) commercially available from Interox Chemicals Limited and having a particle size of 0.1 to 1.0 mm.

In Examples 1 to 7, from 100 to 250 g of the peroxyacid granules were treated in a rotary evaporator with a solution of the surface treatment agent in dichloromethane. The volume of solvent employed was approximately 1 to 1.25 ml per g peroxyacid granules, and the concentration of surface treatment agent therein was adjusted to provide the required residue of agent on the granules.

The granules and solution were slurried until all the granules had been wetted and the slurry introduced into rotary evaporation. The solvent was evaporated off at ambient temperature and reduced pressure in the evaporator until the solid was almost dry. The solid was then stirred to break up any agglomerates and the remainder of the solvent permitted to evaporate at ambient temperature and pressure.

The dye damage of peroxyacid-containing compositions was determined by sprinkling a sample (5 g) evenly across the surface of a 14 cm diameter circle of white bleached cotton dyed with Procion blue onto which had been poured Cheshire tap water at 15° C. in a round tray (15 cm diameter). The fabric was allowed to stand unagitated for 5 minutes and was then rinsed and dried. The dried fabrics were then assessed by eye (three observers) against an arbitrary chart. The compositions used were as follows:

| | A/% | B/% |
|---|---|---|
| Anionic | 5 | 12 |
| Nonionic | 2 | 2 |
| Soap | — | 4 |
| $Na_2CO_3$ | 1 | 1 |
| $Na_2SO_4$ | 34 | 32 |
| $Na_5P_3O_{10}$ | 32 | 30 |
| $Na_2SiO_3$ | 5 | 8 |
| NaCl | 1 | 0.5 |
| Peracid | 6 | 1 |
| $H_2O$, OBA's etc | to 100 | to 100 |

By way of comparison, when similar tests were performed but using peroxyacids in the same compositions but treated with 10% by weight of a range of possible agents that would be expected to be compatible with the peroxyacid, including magnesium hydrogen phthalate, acacia gum, magnesium sulfate, sodium sulfate, gelatin mixed with acacia gum, lanolin alcohol and acetylated lanolin the resultant dye damage was not distinguishable from that from using the untreated peroxyacid. It can be seen therefore that it was not predictable that the invention treatments would ameliorate dye damage.

In Examples 1, 2 and 3 the surface treatment agent was methyl dihydrogenated tallow amine which had a melting point of about 30°–35° C. It was employed in amounts of respectively 10, 15 and 20% w/w based on the weight of magnesium monoperoxyphthalate. On a scale in which 0 represents no amelioration, 1 to 3 represent increasing extents of amelioration and 4 represents virtually complete amelioration, Ex 1 yielded a result of 3, Ex 2 of 3–4 and Ex 3 of 4.

In Example 4, Example 2 was repeated but using a 1:1 weight ratio of methyl dihydrogenated tallow amine and sorbitan tristearate in an amount of 15%. In dye damage trial a result of 4 was achieved.

In Example 5, the surface treatment agent was dicocoamine, melting at about 40°–47° C., in an amount of 20%. In the dye damage trial the result of 3–4 was achieved.

In Examples 6 and 7, the surface treatment agent was primary hydrogenated tallow amine stearylamine melting at about 40°–50° C. in respectively 10% and 20% w/w coatings. The results in the dye damage trials were respectively 3–4 and 4.

EXAMPLE 8

In this Example, a Morton mixer was charged with peroxyacid granules (1500 g) and mixed throughout at about 130 rpm. The mixture was heated to and maintained at 55° C. by hot water/steam passed through the outer jacket of the mixer. Methyl dihydrogenated amine (225 g) was heated to 75° C. and the molten substance sprayed onto the heated mixture at a rate of 28 g/min at an atomizing air pressure of $5\times10^4$ Pa (gauge). When all the substance had been sprayed in, the material was cooled to 30° C. by passing cold water through the outer jacket.

When the product was tested for dye damage the result was 3–4.

We claim:

1. A process for treating a particulate water-soluble peroxyacid so as to ameliorate dye damage caused by contact between a particulate water-insoluble peroxyacid and a damp fabric, in which the particulate water-soluble peroxyacid is surface-treated with an effective amount of an amine which melts or softens at a temperature of from about 35° C. to 60° C., said amine being selected from hydrogenated tallow amine, dihydrogenated tallow amine, methyl dihydrogenated tallow amine and dicocoamine.

2. A process according to claim 1 in which the amount of surface treatment agent is selected in the range of from 8 to 25% by weight of the untreated peroxyacid.

3. A process according to claim 1 in which the surface treatment agent is applied by liquifying the agent and bringing the liquified agent into contact with agitated particles of the peroxyacid.

4. A process according to claim 3 in which the liquified agent is sprayed on to the particles.

5. A process according to claim 3 in which the liquified agent is obtained by melting or by dissolution in a low boiling point organic non-ethereal solvent.

6. A process according to claim 5 in which the solvent is an aliphatic ester or chlorinated aliphatic hydrocarbon.

7. A process according to claim 1 in which the water-soluble peroxyacid is potassium monopersulphate, magnesium monoperoxyphthalate or potassium-4-sulphoperoxybenzoic acid.

8. A particulate peroxygen composition having a reduced tendency to cause dye damage on damp fabric comprising particles having a core of a water-soluble peroxyacid and a coating around the core of from 8 to 30% by weight based on the core of an amine which melts or softens at a temperature of 35° C. to 60° C., said amine being selected from hydrogenated tallow amine, dihydrogenated tallow amine, methyl dihydrogenated tallow amine and dicocoamine.

9. A composition according to claim 8 in which the core comprises potassium monopersulphate, magnesium monoperoxyphthalate or potassium-4-sulphoperoxybenzoic acid.

* * * * *